US008302790B2

(12) United States Patent
Dumey

(10) Patent No.: US 8,302,790 B2
(45) Date of Patent: Nov. 6, 2012

(54) RAILWAY COUPLER KNUCKLE

(75) Inventor: Timothy Dumey, Troy, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 139 days.

(21) Appl. No.: 12/806,408

(22) Filed: Aug. 13, 2010

(65) Prior Publication Data

US 2012/0037586 A1 Feb. 16, 2012

(51) Int. Cl.
*B61G 3/04* (2006.01)

(52) U.S. Cl. ..... 213/151; 213/155

(58) Field of Classification Search ..... 213/109, 213/118, 140, 151, 152, 155
See application file for complete search history.

(56) References Cited

U.S. PATENT DOCUMENTS 5,582,307 A 12/1996 Hawthorne et al.
5,954,212 A * 9/1999 Beatty et al. ..... 213/155
6,129,227 A * 10/2000 Openchowski et al. ..... 213/111

* cited by examiner

*Primary Examiner* — S. Joseph Morano
*Assistant Examiner* — Zachary Kuhfuss
(74) *Attorney, Agent, or Firm* — Edward J. Brosius

(57) ABSTRACT

Railway coupler knuckle apparatus are described herein. An example railway coupler knuckle includes a tail portion, a hub portion and a transition portion joining the tail portion and the hub portion. The hub portion includes a generally cylindrical pivot pin passage having a longitudinal axis. The railway coupler knuckle has a cavity formed inside the tail portion and at least a portion of the transition portion and a first wall extends between surfaces of the cavity adjacent the transition portion.

11 Claims, 5 Drawing Sheets

RAILWAY COUPLER KNUCKLE

This disclosure relates generally to railway couplers and, more particularly, to railway coupler knuckle apparatus having internal support structure.

BACKGROUND

Association of American Railroads (AAR) type E, type F and/or type E/F couplers are commonly employed in a railway car coupling systems. Type E couplers typically include a knuckle portion coupled to a tail portion via a transition portion. A hub pivotally couples the knuckle portion to a coupler head such that the tail pivots or rotates within a channel of the coupler head to engage a pulling surface to enable the coupler system of a leading railway car to pull a trailing railway car. The pulling surfaces of the tail and the coupler head are commonly referred to as pulling lugs.

In general, forming a knuckle to have a solid tail results in a heavy part that is also more likely to develop internal voids that can weaken or reduce the operating life of the knuckle. Thus, the cross-section of a tail of a knuckle typically has an open cored area to reduce the weight of the knuckle (i.e., lighten the knuckle) while providing acceptable internal solidity. The open cored area typically has a tubular or rectangular shaped cross-section. However, the tail may be susceptible to fatigue failure during operation because a relatively high stress is imparted to the tail when the knuckle is interlocked with a mating knuckle of another railway car. AAR standards and specifications (e.g., AAR specification M-211) indicates that the tail portion of a knuckle is a critical area and mandates periodic destructive testing of a used knuckle by cutting the tail portion to expose a cross-section of the tail that is inspected for factures, cracks and/or other damage.

SUMMARY

An example railway car knuckle coupler includes a tail portion, a hub portion and a transition portion joining the tail portion and the hub portion. The hub portion includes a generally cylindrical pivot pin passage having a longitudinal axis. The railway coupler knuckle has a cavity formed inside the tail portion and at least a portion of the transition portion. A first wall extends between surfaces of the cavity adjacent the transition portion.

In another example, a railway coupler knuckle includes a tail portion, a hub portion and a transition portion joining the tail portion and the hub portion that includes a pivot pin passage having a longitudinal axis. The railway coupler knuckle has a cavity formed inside the tail portion and at least a portion of the transition portion. A rib is positioned within the cavity to increase a fatigue life of the railway coupler knuckle.

In yet another example, a railway coupler knuckle includes a tail section and a transition section adjacent the tail section such that the tail section and the transition section define an internal cavity. A support structure extends between surfaces of the internal cavity to increase a strength of the walls of the transition section to increase a fatigue life of the railway coupler knuckle.

DETAILED DESCRIPTION

The example railway coupler knuckle apparatus described herein include a support structure to increase the strength and resistance to fatigue failure of the knuckle. More specifically, an example knuckle apparatus described herein includes a hub portion coupled to a tail portion via a transition portion. The tail portion and/or the transition portion define an internal cavity that includes a support structure. The support structure may be a rib, a wall and/or any other structure that extends between surfaces of the internal cavity to increase the strength of the walls of the tail portion and/or the transition portion, thereby increasing the fatigue life of the railway coupler knuckle without significantly increasing the weight of the knuckle.

Figure 1:
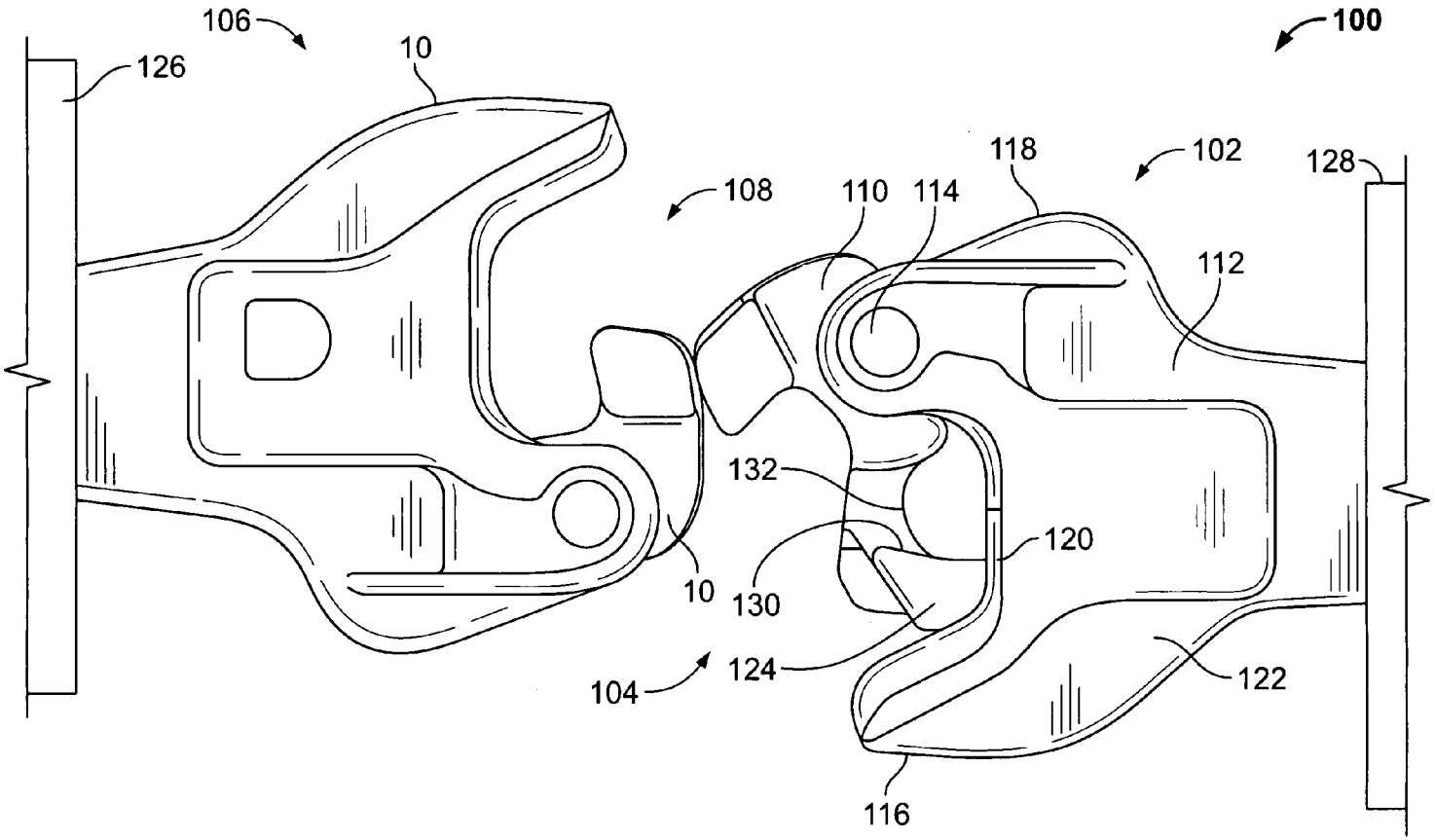
FIG. 1 is top view of a railway coupler system implemented with example knuckle apparatus described herein.

FIG. 1 illustrates a top view of a railway coupler system 100 described herein. The coupler system 100 includes a first railway coupler assembly 102 shown in an open position 104 and a second railway coupler assembly 106 shown in a closed position 108. The second railway coupler assembly 106 is substantially similar or identical to the first railway coupler assembly 102 and, thus, will not be described in detail.

The railway coupler assembly 102 includes a knuckle 110A pivotally coupled to a coupler head 112A via, for example, a pivot pin 114. The coupler head 112A is generally a unitary structure having C-shaped cross-section. The coupler head 112A includes a guard arm 116, a knuckle side 118 and a front face or throat area 120 that interconnects or couples the knuckle side 118 and the guide arm 116. Although not shown, the coupler head 112A includes a pocket forming a channel or cavity between an upper surface 122 of the coupler head 112A and a lower surface opposite the upper surface 122. The knuckle 110A pivots relative to the coupler head 112A and a tail 124 of the knuckle 110A moves within the cavity or channel of the coupler head 112A when the knuckle 110A moves between the open position 104 and the closed position 108 to engage a pulling surface (not shown) of the coupler head 112A.

The coupler assemblies 102 and 106 are brought into contact with each other to couple a leading railway car 126 and a trailing railway car 128. In particular, the trailing knuckle 110A engages a leading knuckle 110B and pivot relative to the respective coupler heads 112A and 112B into an interlocking, engaged position. When engaged and interlocked, a locking mechanism (not shown) mechanically locks the position of the knuckles 110A and 110B relative to the respective coupler heads 112A and 112B so that the first and second railway coupler assemblies 102 and 106 are interlocked. The details of such a coupler locking mechanism and the interaction of the knuckles 110A or 110B and related locking structures are well known and, thus, are not described in detail.

When the knuckle 110A is in the closed position 108, a pulling lug 130 of the tail 124 engages the pulling surface (not shown) of the coupler head 112A to provide a pulling lug connection. Depending on the load and/or speed of the railway cars 126 and 128, a relatively large load or stress may be imparted on the pulling lug 130 of the tail 124. Relatively large loads or stresses imparted to the tail 124 over time may cause the tail 124 and/or a transition portion or area of the knuckle 110 to form cracks or become damaged (e.g., fatigue). As described in greater detail below, the tail 124 of the knuckle 110A is implemented with a support structure within a cavity of the tail 124 and/or the transition portion 132 to increase the strength of the tail 124 and/or the transition portion 132, thereby increasing the fatigue life of the knuckle 110A.

Figure 2A:
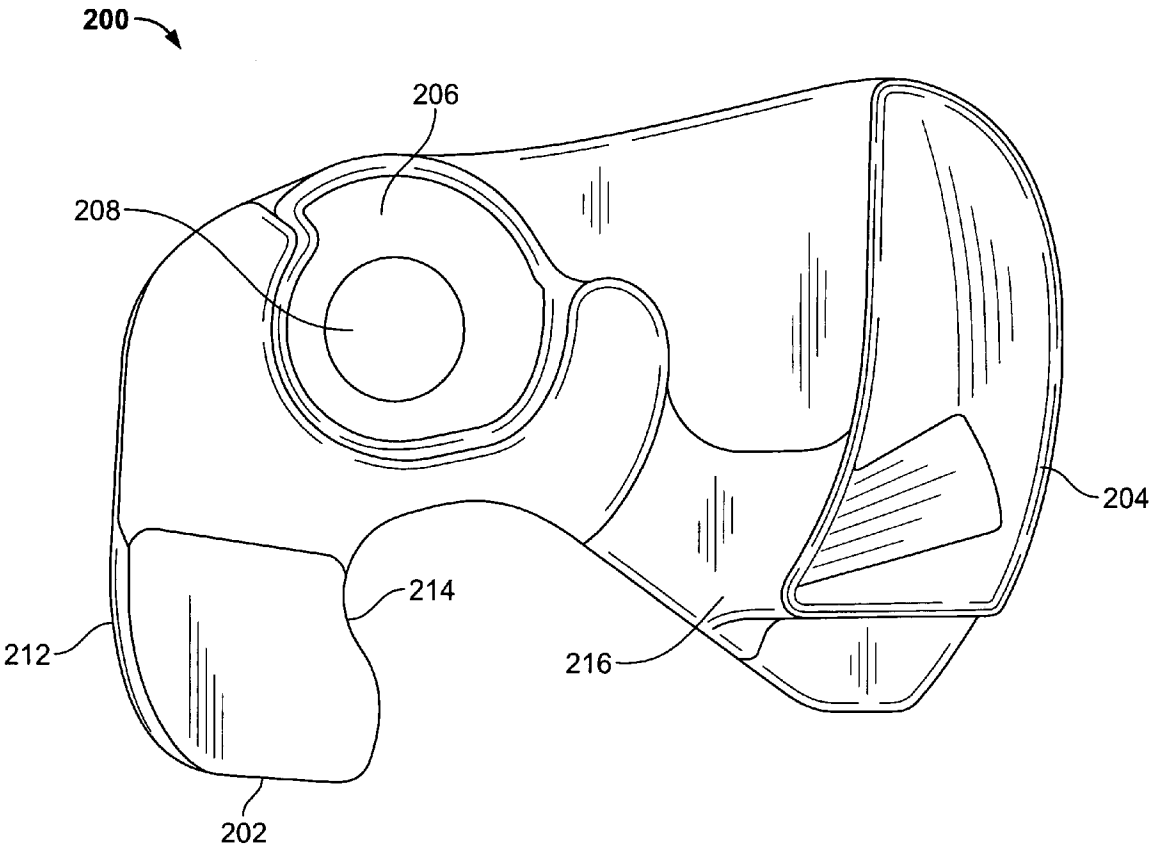
FIG. 2A illustrates a top view of an example railway coupler knuckle described herein that may be used to implement the coupler system of FIG. 1.
Figure 2B:
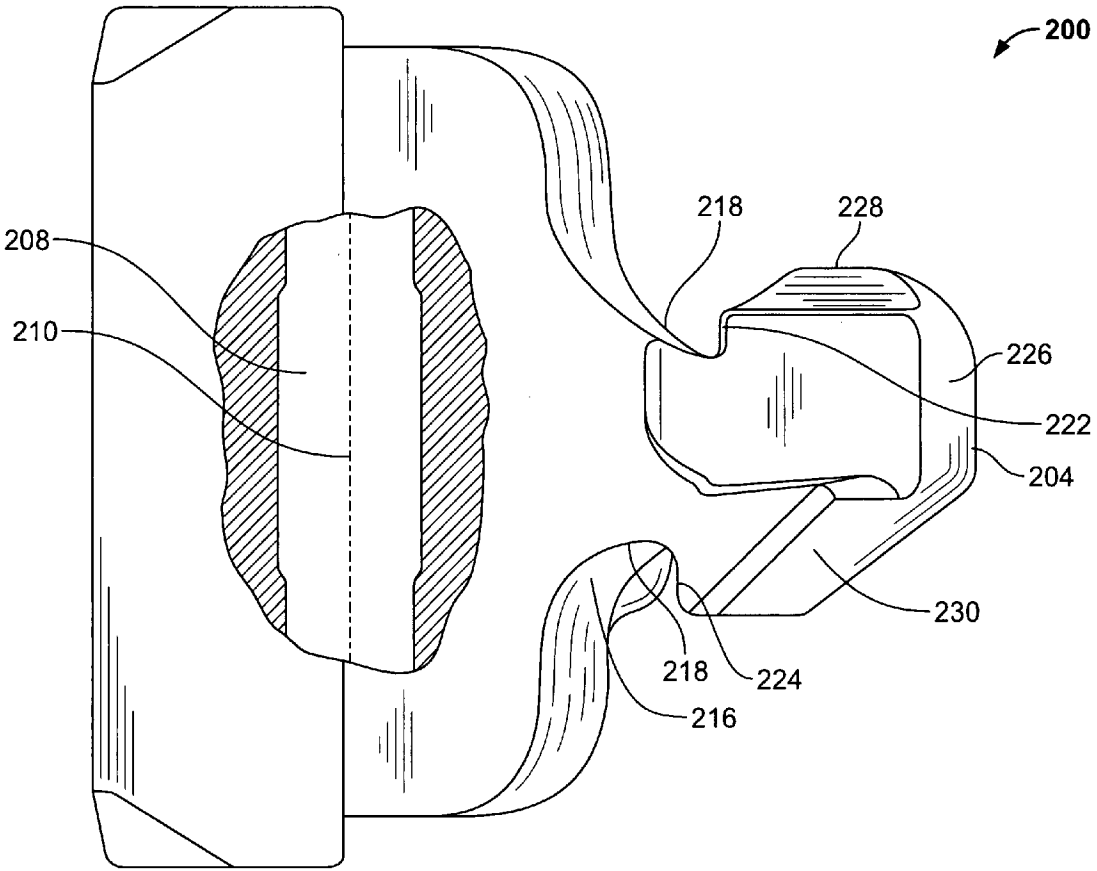
FIG. 2B is a side, partially cut-away view of the example railway coupler knuckle of FIG. 2A.

FIGS. 2A and 2B illustrate an example knuckle 200 that may be used to implement the example coupler system 100 of FIG. 1. FIG. 2A is a top view of the knuckle 200 and FIG. 2B is a partially cut away side view of the knuckle 200. Referring to FIGS. 2A and 2B, the knuckle 200 is a unitary structure having a generally L-shaped profile or shape. The knuckle 200 includes a nose portion 202, a tail portion 204, and a hub portion 206 that joins the nose 202 and the tail 204. The hub 206 includes a generally cylindrical pivot pin passage or opening 208 having a longitudinal axis 210 to pivotally couple the knuckle 200 to a coupler head (e.g., the coupler head 112A of FIG. 1). A front face 212 of the knuckle 200 has a curved surface that extends across the nose 202. Although not shown, in some examples, the nose 202 may include a flag hole and/or cavities to further reduce the weight of the knuckle 200. The front face 212 and/or the nose 202 of the knuckle 200 slides against a front face and/or a nose of a mating knuckle to cause the knuckles to pivot relative to their respective coupler heads into an interlocking, engaged position.

The knuckle 200 also includes a pulling face 214 adjacent (e.g., inward from) the nose 202 that is configured to engage a similar pulling face of a mating knuckle when the knuckle 200 is coupled to the mating knuckle in a locked condition. A transition area or portion 216 extends from the pulling face 214 toward the tail 204 and joins the hub 206 and the tail 204. The transition portion 216 is typically an arcuate section that has an increasing radius of curvature from the nose 202 toward the tail 204. For example, the transition portion 216 includes opposed upper and lower curved (e.g., parabolic shaped) walls 218 and 220 that lead to the tail 204. The tail 204 provides a raised pulling lug that includes pulling surfaces 222 and 224 (e.g., substantially vertical pulling surfaces) between the respective upper and lower walls 218 and 220 of the transition area 216 and a rear surface 226 of the tail 204. The tail 204 includes an upper surface 228 and a lower surface 230 to join the respective pulling surfaces 222 and 224 and the rear surface 226. As noted above, the tail 204 and the pulling surfaces 222 and 224 rotate within a channel or cavity of a coupler head (e.g., the coupler head 112A) when the knuckle 200 rotates between an open position (e.g., the open position 104 of FIG. 1) and a closed position (e.g., the closed position 108 of FIG. 1). When the knuckle 200 is in the closed position relative to the coupler head, the pulling surfaces 222 and 224 engage a pulling surface of the coupler head. Such an engagement is commonly referred to as the pulling lug connection. In operation, with knuckle 200 in a pull condition relative to a mating knuckle of an adjacent or leading rail car, the primary pulling force is exerted against the pulling surfaces 222 and 224. Thus, such a pulling force may be relatively high and there is a stress concentration at the pulling surfaces 222 and 224.

Figure 3B:
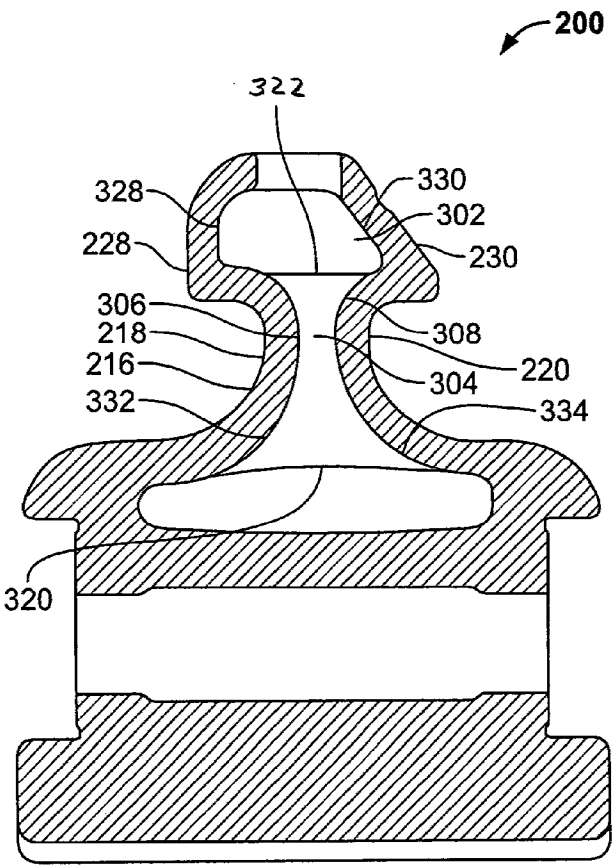
FIG. 3B illustrates a cross-sectional side view of the example railway coupler knuckle apparatus of FIGS. 2A, 2B and 3A taken along line 3B-3B of FIG. 3A.
Figure 3A:
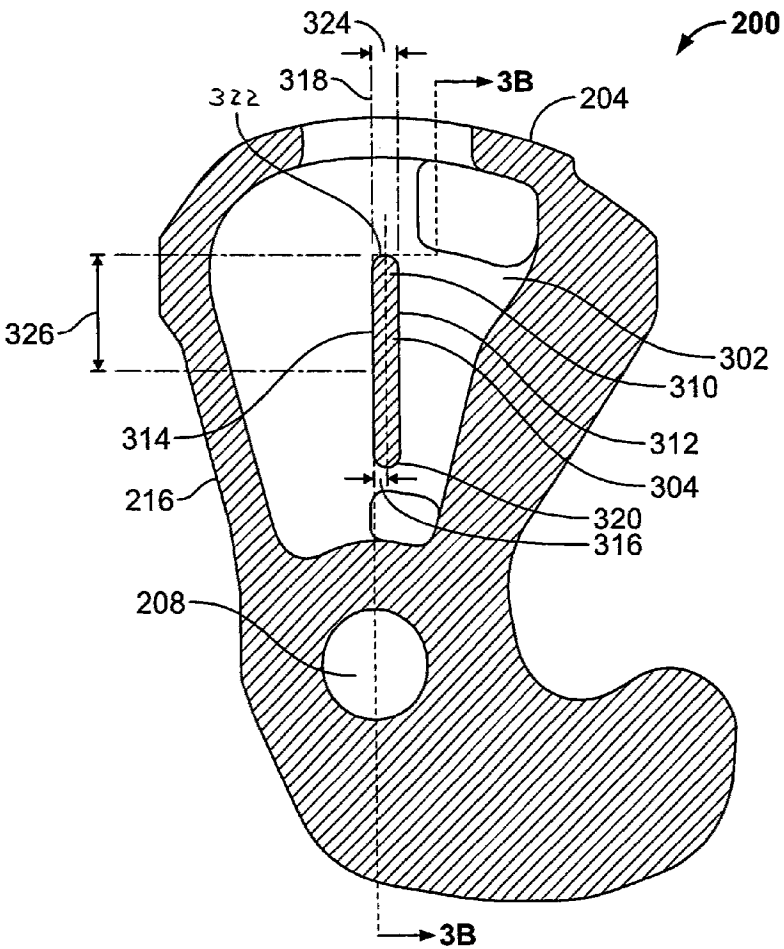
FIG. 3A illustrates a cross-sectional top view of the example railway coupler knuckle apparatus of FIGS. 2A and 2B.

FIG. 3A illustrates a cross-sectional view of the knuckle 200 of FIGS. 2A and 2B. FIG. 3B illustrates a cross-sectional view of the knuckle 200 taken along line 3B-3B of FIG. 3A. Referring to FIGS. 3A and 3B, the example knuckle 200 includes a cavity 302 between at least a portion of the tail 204 and/or the transition portion 216. A support structure 304 is formed (e.g., integrally formed) within the cavity 302 between the upper surface 228 and the lower surface 230 of the tail 204 adjacent the transition portion 216. In other words, the support structure 304 extends between surfaces 306 and 308 of the internal cavity 302 to increase the strength of the tail 204 (e.g., the pulling surfaces 222 and 224) and/or the transition portion 216 (e.g., the upper and lower walls 218 and 220), thereby increasing a fatigue life of the knuckle 200. In this example, the support structure 304 is a generally vertical wall or rib 310 extending between surfaces 306 and 308 of the cavity 302 adjacent the transition portion 216.

As shown, the wall or rib 310 is positioned approximately centrally within the cavity 302 and has sides or faces 312 and 314 that are generally parallel to the longitudinal axis 210 (FIG. 2B) of the pivot pin passage 208. In some examples, the wall or rib 310 may be located at any suitable distance 316 relative to a longitudinal axis 318 of the knuckle 200. For example, the rib 310 may be offset by a distance (e.g., a lateral distance) relative to the longitudinal axis 318 or the rib may be radially spaced relative to longitudinal axis by an angle (e.g., between about 20 degrees and 40 degrees) Also, in this example, the wall or rib 310 has curved opposing ends 320 and 322. In some examples, the wall or rib 310 may have straight ends or any other suitably shaped ends. The wall or rib 310 may have a thickness 324 of between about 0.25 inches and 0.50 inches. More specifically, in this example, the thickness 324 of the wall or rib 310 is about 0.38 inches. Further, the wall or rib 310 may have a length 326 of between about 1.5 inches and 3.5 inches. More specifically, in this example, the length 326 of the wall or rib 310 is about 3.19 inches. In some examples, the wall or rib 310 may be disposed between surfaces 328 and 330 of the tail portion and/or surfaces 332 and 334 of the transition portion 216. For example, a structure may be disposed between the surfaces 328 and 330 and/or a structure may be disposed between the surfaces 332 and 334 in addition to the wall or rib 310 or without the wall or rib 310. In other examples, the knuckle 200 may include a plurality of support structures (e.g., the support structure 304) within the cavity 302 of the tail 204 and/or the transition portion 216.

Figure 4B:
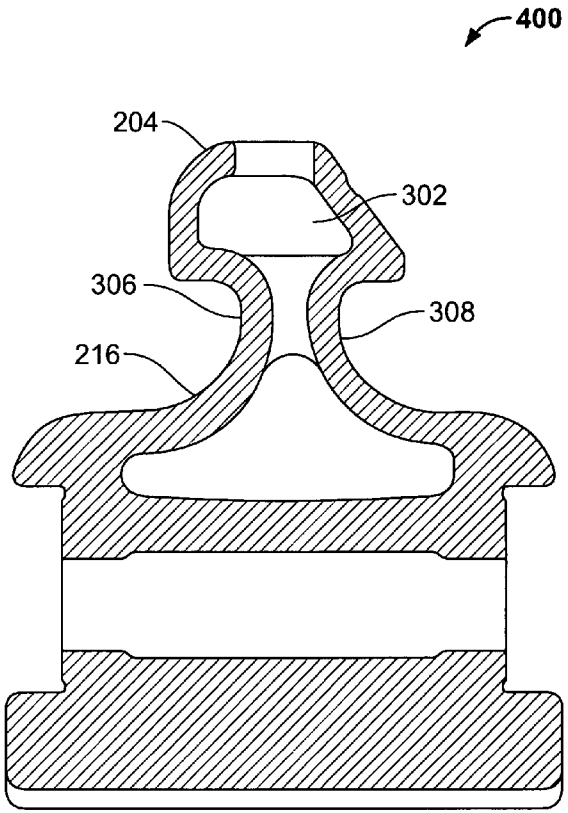
FIG. 4B illustrates a cross-sectional side view of the example railway coupler knuckle apparatus of FIG. 4A taken along line 4B-4B.
Figure 4A:
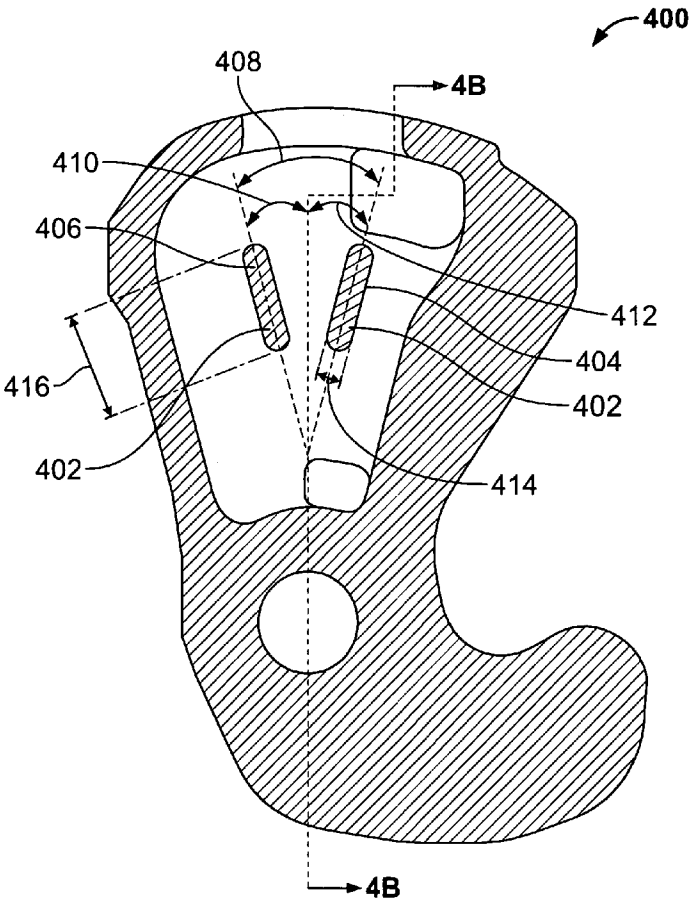
FIG. 4A illustrates a cross-sectional top view of another example railway coupler knuckle apparatus described herein.

FIGS. 4A and 4B are cross-sectional views of another example knuckle 400 described herein. Those components of the example knuckle 400 of FIGS. 4A and 4B that are substantially similar or identical to those components of the example knuckle 200 described above and that have functions substantially similar or identical to the functions of those components will not be described in detail again below. Instead, the interested reader is referred to the above corresponding descriptions in connection with FIGS. 2A, 2B, 3A and 3B. Those components that are substantially similar or identical will be referenced with the same reference numbers as those components described in connection with FIGS. 2A, 2B, 3A and 3B.

Referring to FIGS. 4A and 4B, the example knuckle 400 includes a plurality of support structures 402 positioned within the cavity 302 of the tail 204 to increase the fatigue life of the knuckle 400. For example, the support structures 402 may be a first wall or rib 404 and a second wall or rib 406. In this example, the walls or ribs 404 and 406 extend between the surfaces 306 and 308 of the cavity 302 of the tail 204 adjacent the transition portion 216. The first wall or rib 404 is radially spaced from the second wall or rib 406. For example, the first wall or rib 404 may be radially spaced from the second wall or rib 406 at a distance or angle 408 of between about, for example, 20 degrees and 30 degrees. More specifically, as shown, the first wall or rib 404 is radially spaced from the second wall or rib 406 by about 30 degrees. However, in other examples, the first and second walls or ribs 404 and 406 may be radially spaced at any suitable angle. For example, the first wall or rib 404 may be radially spaced relative to the longitudinal axis 318 of the knuckle 400 at a first angle 410 and the second wall or rib 406 may be radially spaced relative to the longitudinal axis 318 at a second angle 412 different from the first angle 410.

As shown, the first and second walls or ribs 404 and 406 have substantially the same thicknesses 414 and substantially the same lengths 416. For example, the first and second walls or ribs 404 and 406 may have thicknesses 414 between about 0.25 inches and 0.5 inches and have lengths 416 between about 1.5 inches and 3.5 inches. More specifically, in this example, the thickness of the first and second walls or ribs 404 and 406 is about 0.38 inches and the length is about 1.75 inches. However, in other examples, each of the first and second walls or ribs 404 and 406 may have different thicknesses and/or lengths.

The railway car coupler knuckles 110A, 110B, 200 and 400 may be composed of steel or metal and may be manufactured via a casting operation as a unitary structure. The casting operation typically includes a top or core mold section formed of casting sand and a bottom or drag mold section also formed of casting sand. Cores of resin or otherwise hardened sand are placed in the drag section prior to closing the mold assembly by placing the cop mold section on top of the drag. For example, the pivot aperture of the knuckle is formed via a pivot pin core. Likewise, the cavity is formed via a pulling lug core. Further, the support structure or structures described herein (e.g., the ribs 310, 404 and 406) are also integrally formed with the knuckle via the pulling lug core. A material, for example, molten steel, is poured in the mold, taking up all space that is open between the cope, the drag and the cores. For example, the pulling lug core may include a body to form the cavity of the tail, and the body may include an opening or aperture (or a plurality of openings) that receives molten material during casting to form the wall or rib 310 (or the plurality of walls or ribs 404 and 406) within the cavity 302. Also, the body may include upper and lower curved surfaces (e.g., parabolic shaped surfaces) to form the transition portion 216 of the knuckle 200 and 400.

After solidifying, the mold is opened and the casting removed, whereby the cores are broken up and removed from openings in the casting. As a result, the knuckle includes internal support structure such as a wall or rib (or ribs) positioned within the cavity of the tail and/or the transition portion to increase a fatigue life of the railway coupler knuckle. Secondary manufacturing operations may be provided after casting. For example, the surfaces of the knuckle may be flame hardened or any surface discontinuities in the transition area may be removed via, for example, grinding or any other suitable methods.

The example railway coupler knuckles described herein significantly reduce fatigue to the tail and/or the transition portion of the knuckle. In particular, the internal support structure or structures of the described knuckles significantly increase the strength of the tail and/or transition portion to make the knuckle stronger and more resistant to fatigue failure in service, while maintaining a reduced weight of the knuckle. By increasing the fatigue life of the knuckle, significantly less destructive testing per the AAR specifications may be performed compared to knuckles that do not have the support structures or ribs in the cavity of the tail and/or transition portion. Although the example knuckles described herein are illustrated as AAR Type E knuckles, the support structures 304 and 402 may be implemented with AAR Type F knuckles and/or any other suitable knuckles for use with railway coupler systems.

Although certain apparatus have been described herein, the scope of coverage of this patent is not limited thereto. To the contrary, this patent covers all apparatus fairly falling within the scope of the appended claims either literally or under the doctrine of equivalents.

What is claimed is:

1. A railway coupler knuckle, comprising:

a tail portion, a hub portion and a transition portion joining the tail portion and the hub portion, wherein the hub portion includes a generally cylindrical pivot pin passage having a longitudinal axis, and wherein the railway coupler knuckle has a cavity formed inside the tail portion and at least a portion of the transition portion; and a first wall extending between surfaces of the cavity adjacent the transition portion, wherein opposing faces of the first wall are generally parallel to the longitudinal axis of the pivot pin passage, and wherein the first wall is radially spaced from 20 to 30 degrees relative to a longitudinal axis of the cavity.

2. A railway coupler knuckle as defined in claim 1, wherein first wall is integrally formed with the tail portion and the transition portion.

3. A railway coupler knuckle as defined in claim 1, wherein first wall extends across substantially the entire transition portion.

4. A railway coupler knuckle as defined in claim 1, wherein the first wall has a thickness of between about 0.25 inches and 0.5 inches.

5. A railway coupler knuckle as defined in claim 1, wherein the first wall has a length of between about 1.5 inches and 3.5 inches.

6. A railway coupler knuckle as defined in claim 1, wherein the first wall has curved opposing ends.

7. A railway coupler knuckle as defined in claim 1, wherein the first wall is positioned approximately centrally within the cavity.

8. A railway car coupler knuckle, comprising:

a tail portion, a hub portion and a transition portion joining the tail portion and the hub portion, wherein the hub portion includes a pivot pin passage having a longitudinal axis, and wherein the railway coupler knuckle has a cavity formed inside the tail portion and at least a portion of the transition portion; and a rib positioned within the cavity to increase a fatigue life of the railway coupler knuckle, wherein the rib extends between opposing surfaces of the cavity adjacent the transition portion, and wherein the rib has faces that are generally parallel to the longitudinal axis of the pivot pin passage, wherein the first rib is radially spaced from 20 to 30 degrees relative to a longitudinal axis of the cavity.

9. A railway coupler knuckle as defined in claim 8, wherein the rib is integrally formed with the railway coupler knuckle.

10. A railway coupler knuckle as defined in claim 8, wherein the rib is radially spaced relative to a longitudinal axis of the cavity.

11. A railway coupler knuckle, comprising:

a tail portion, a hub portion and a transition portion joining the tail portion and the hub portion, wherein the hub portion includes a generally cylindrical pivot pin passage having a longitudinal axis, and wherein the railway coupler knuckle has a cavity formed inside the tail portion and at least a portion of the transition portion; and a first wall extending between surfaces of the cavity adjacent the transition portion, wherein opposing faces of the first wall are generally parallel to the longitudinal axis of the pivot pin passage, further comprising a second wall extending between surfaces of the cavity adjacent the transition portion.

* * * * *